US008905002B2

(12) United States Patent
Serra et al.

(10) Patent No.: US 8,905,002 B2
(45) Date of Patent: Dec. 9, 2014

(54) FUEL INJECTOR ASSEMBLY

(75) Inventors: Giandomenico Serra, S.Giuliano Terme (IT); Gisella Di Domizio, San Giuliano Terme (IT); Edoardo Giorgetti, Rosignano Marittimo (IT); Daniel Marc, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 249 days.

(21) Appl. No.: 13/639,248

(22) PCT Filed: Apr. 6, 2011

(86) PCT No.: PCT/EP2011/055301
§ 371 (c)(1), (2), (4) Date: Dec. 12, 2012

(87) PCT Pub. No.: WO2011/124581
PCT Pub. Date: Oct. 13, 2011

(65) Prior Publication Data

US 2013/0092129 A1 Apr. 18, 2013

(30) Foreign Application Priority Data

Apr. 8, 2010 (EP) ..... 10003786

(51) Int. Cl.
*F02M 61/14* (2006.01)
*F02M 69/46* (2006.01)
*F02M 55/02* (2006.01)

(52) U.S. Cl.
CPC ..... *F02M 69/46* (2013.01); *F02M 69/465* (2013.01); *F02M 2200/856* (2013.01); *F02M 61/14* (2013.01); *F02M 55/025* (2013.01); *F02M 2200/8023* (2013.01)
USPC ..... 123/470; 123/469

(58) Field of Classification Search
CPC ..... F02M 61/14; F02M 61/168
USPC ..... 123/468–470
See application file for complete search history.

(56) References Cited

U.S. PATENT DOCUMENTS 4,066,213 A 1/1978 Stampe ..... 239/533.3
6,314,943 B1 * 11/2001 Burch et al. ..... 123/470

(Continued)

FOREIGN PATENT DOCUMENTS

EP 2093412 A1 8/2009 ..... F02M 55/00
EP 2093413 A1 8/2009 ..... F02M 55/00

(Continued)

OTHER PUBLICATIONS

European Search Report, Application No. 10003786.0-2311, 4 pages, Sep. 17, 2010.

(Continued)

*Primary Examiner* — Erick Solis
(74) *Attorney, Agent, or Firm* — King & Spalding L.L.P.

(57) ABSTRACT

A fuel injector assembly has a fuel injector and a coupling device for hydraulically and mechanically coupling a fuel injector to a fuel rail of a combustion engine. The coupling device includes a fuel injector cup configured to be hydraulically coupled to the fuel rail and to engage a fuel inlet portion of the fuel injector, a plate element fixedly coupled to the fuel injector cup and comprising a groove, and a snap ring arranged in the groove and configured to fixedly couple the plate element to the fuel injector to retain the fuel injector in the fuel injector cup in direction of a central longitudinal axis of the fuel injector and to prevent a movement of the fuel injector relative to the plate element in a first direction of the central longitudinal axis. A circlip arranged axially between the fuel injector and the plate element prevents a movement of the fuel injector relative to the plate element in a second, opposite direction of the central longitudinal axis.

9 Claims, 3 Drawing Sheets

(56) References Cited

U.S. PATENT DOCUMENTS

| | | | | |
|---|---|---|---|---|
| 6,845,758 | B2 * | 1/2005 | Seymour et al. | 123/470 |
| 7,293,550 | B2 * | 11/2007 | Beardmore | 123/470 |
| 7,861,692 | B2 * | 1/2011 | Biasci et al. | 123/470 |
| 8,286,612 | B2 * | 10/2012 | Biasci et al. | 123/470 |
| 2008/0169364 | A1 | 7/2008 | Zdroik et al. | 239/533.2 |
| 2009/0229576 | A1 * | 9/2009 | Biasci et al. | 123/470 |
| 2009/0235899 | A1 * | 9/2009 | Biasci et al. | 123/470 |
| 2010/0012093 | A1 * | 1/2010 | Pepperine et al. | 123/470 |
| 2010/0018502 | A1 * | 1/2010 | Fischetti et al. | 123/470 |

FOREIGN PATENT DOCUMENTS

| | | | | |
|---|---|---|---|---|
| EP | 2093414 | A1 | 8/2009 | F02M 55/00 |
| WO | 2011/124581 | A1 | 10/2011 | F02M 55/02 |

OTHER PUBLICATIONS

International Search Report and Written Opinion, Application No. PCT/EP2011/055301, 8 pages, May 9, 2011.

* cited by examiner

FUEL INJECTOR ASSEMBLY

CROSS-REFERENCE TO RELATED APPLICATIONS

This application is a U.S. National Stage Application of International Application No. PCT/EP2011/055301 filed Apr. 6, 2011, which designates the United States of America, and claims priority to EP Application No. 10003786.0 filed Apr. 8, 2010, the contents of which are hereby incorporated by reference in their entirety.

TECHNICAL FIELD

This disclosure relates to a fuel injector assembly with a fuel injector and a coupling device for hydraulically and mechanically coupling the fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Fuel rails can comprise a hollow body with recesses in form of fuel injector cups. The fuel injectors are attached to the fuel injector cups. The connection of the fuel injectors to the fuel injector cups that supply the fuel from a fuel tank via a low or high-pressure fuel pump needs to be very precise to get a correct injection angle and a sealing of the fuel.

SUMMARY

In one embodiment, a fuel injector assembly includes a fuel injector and a coupling device for hydraulically and mechanically coupling the fuel injector to a fuel rail of a combustion engine, the fuel injector having a central longitudinal axis, the coupling device comprising: a fuel injector cup being designed to be hydraulically coupled to the fuel rail and to engage a fuel inlet portion of the fuel injector, a plate element being fixedly coupled to the fuel injector cup and comprising a groove, and a snap ring being arranged in the groove and being designed to fixedly couple the plate element to the fuel injector to retain the fuel injector in the fuel injector cup in direction of the central longitudinal axis and to prevent a movement of the fuel injector relative to the plate element in a first direction of the central longitudinal axis, wherein a circlip is arranged axially between the fuel injector and the plate element to prevent a movement of the fuel injector relative to the plate element in a second direction of the central longitudinal axis opposing the first direction of the central longitudinal axis.

In a further embodiment, the fuel injector comprises a shoulder extending in radial direction and the circlip is arranged axially between the shoulder and the plate element. In a further embodiment, the plate element and the fuel injector cup are designed and arranged to enable a screw coupling between the plate element and the fuel injector cup.

BRIEF DESCRIPTION OF THE DRAWINGS

Example embodiments will be explained in more detail below with reference to figures, in which.

DETAILED DESCRIPTION

Figure 1:
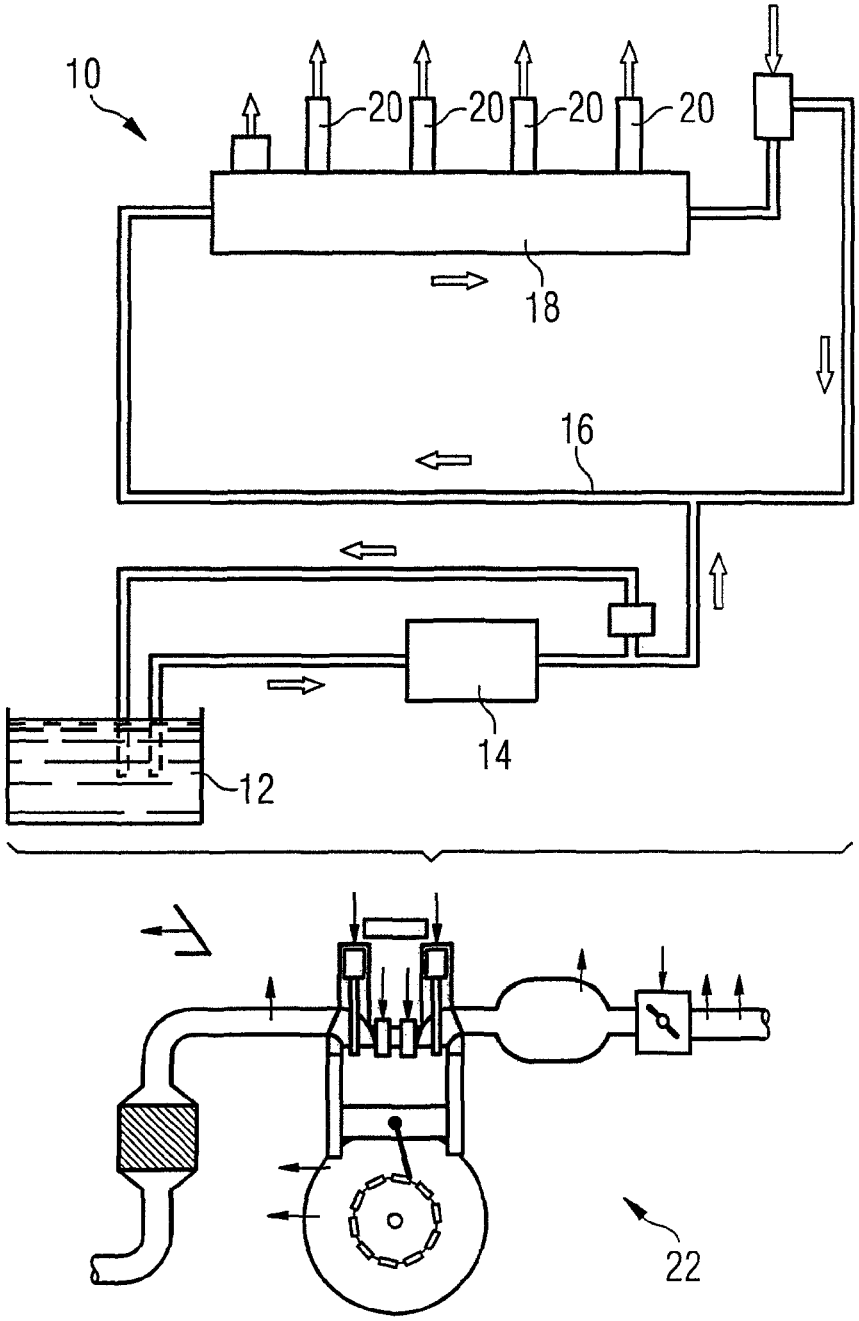
FIG. 1 an internal combustion engine in a schematic view.

Some embodiments provide a fuel injector assembly with a fuel injector and a coupling device for hydraulically and mechanically coupling the fuel injector to a fuel rail, wherein the fuel injector assembly is simply to be manufactured and facilitates a reliable and precise connection between the fuel injector and the fuel injector cup without a resting of the fuel injector on the cylinder head.

Some embodiments provide a fuel injector assembly with a fuel injector and a coupling device for hydraulically and mechanically coupling the fuel injector to a fuel rail of a combustion engine. The fuel injector has a central longitudinal axis. The coupling device comprises a fuel injector cup being designed to be hydraulically coupled to the fuel rail and to engage a fuel inlet portion of the fuel injector, a plate element being fixedly coupled to the fuel injector cup and comprising a groove, and a snap ring. The snap ring is arranged in the groove and is designed to fixedly couple the plate element to the fuel injector to retain the fuel injector in the fuel injector cup in direction of the central longitudinal axis and to prevent a movement of the fuel injector relative to the plate element in a first direction of the central longitudinal axis. A circlip is arranged axially between the fuel injector and the plate element to prevent a movement of the fuel injector relative to the plate element in a second direction of the central longitudinal axis opposing the first direction of the central longitudinal axis.

In this manner a movement of the fuel injector relative to the fuel injector cup in both directions of the central longitudinal axis may be prevented. The circlip may be easily mounted and disassembled. Furthermore, the circlip does not exert an additional force on the injector during the assembly process. During the mounting of the plate element and the snap ring there is enough space to enable a limited movement of the injector relative to the plate element and the snap ring. As the circlip can be arranged outside the fuel injector cup the circlip can be assembled and disassembled without disassembling the fuel injector cup from the injector.

In one embodiment the fuel injector comprises a shoulder extending in radial direction, and the circlip is arranged axially between the shoulder and the plate element. The shoulder may thus offer a secure supporting surface for the circlip. Consequently, the shoulder enables a defined positioning of the fuel injector relative to the fuel injector cup in axial direction.

In a further embodiment the plate element and the fuel injector cup are designed and arranged to enable a screw coupling between the plate element and the fuel injector cup. This may provide a simple construction of the coupling device which allows carrying out a fast and secure coupling of the fuel injector in the fuel injector cup. Furthermore, a defined positioning of the fuel injector relative to the fuel injector cup in axial and circumferential direction is enabled.

With reference to FIG. 1, A fuel feed device 10 is assigned to an internal combustion engine 22, which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18.

Figure 2:
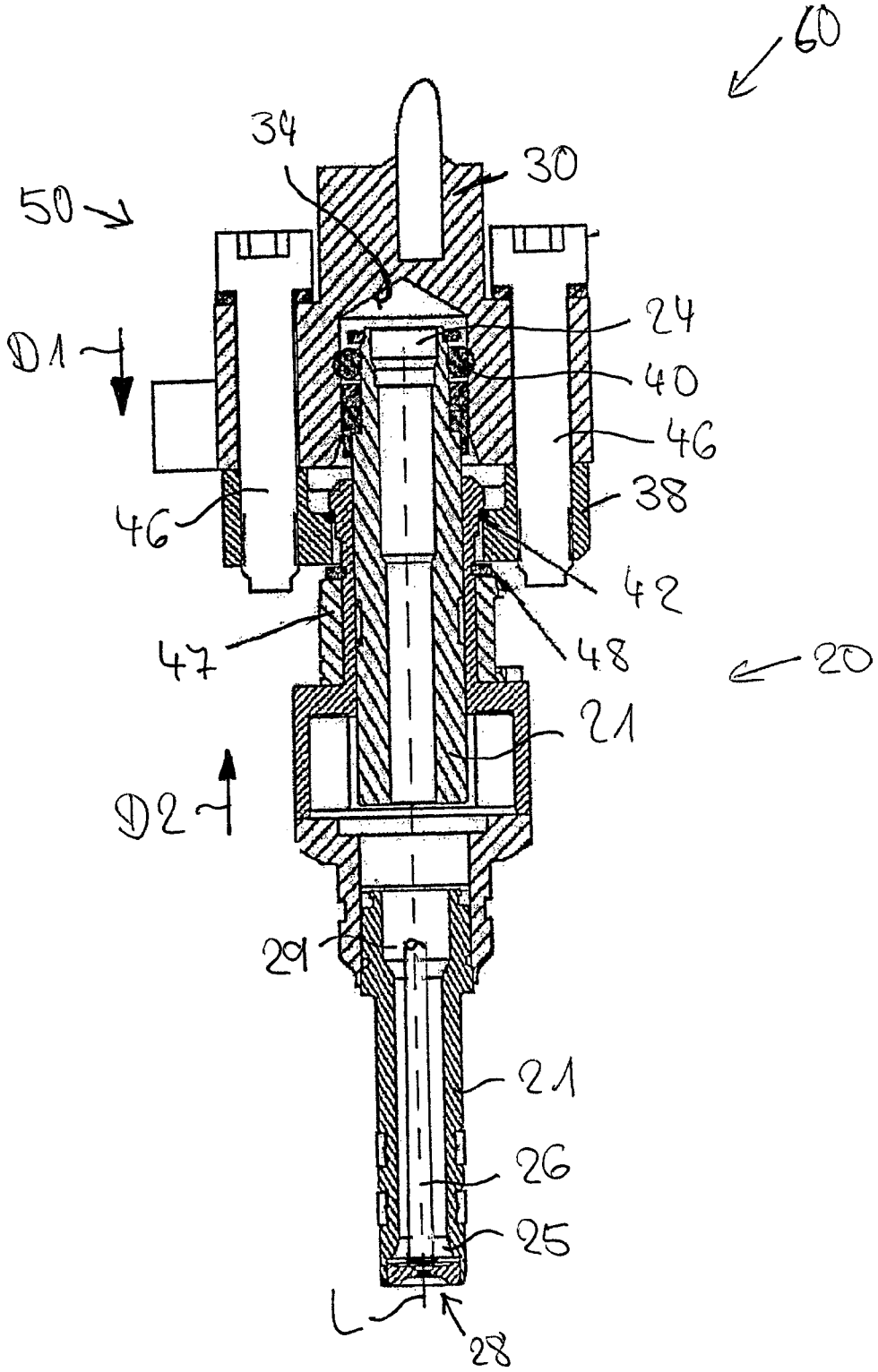
FIG. 2 a longitudinal section through a fuel injector assembly with a coupling device, and FIG. 3 a longitudinal section through the fuel injector assembly.

FIG. 2 shows the fuel injector 20 with a central longitudinal axis L. The fuel injector 20 has a fuel injector body 21 and is suitable for injecting fuel into a combustion chamber of the internal combustion engine 22. The fuel injector 20 has a fuel inlet portion 24 and a fuel outlet portion 25.

Furthermore, the fuel injector 20 comprises a valve needle 26 taken in a cavity 29 of the fuel injector body 21. On a free end of the fuel injector 20 an injection nozzle 28 is formed which is closed or opened by an axial movement of the valve needle 26. In a closing position a fuel flow through the injection nozzle 28 is prevented. In an opening position fuel can flow through the injection nozzle 28 into the combustion chamber of the internal combustion engine 22. The fuel injector 20 further comprises a groove 27 which is arranged at an outer surface of the fuel injector body 21.

Figure 3:
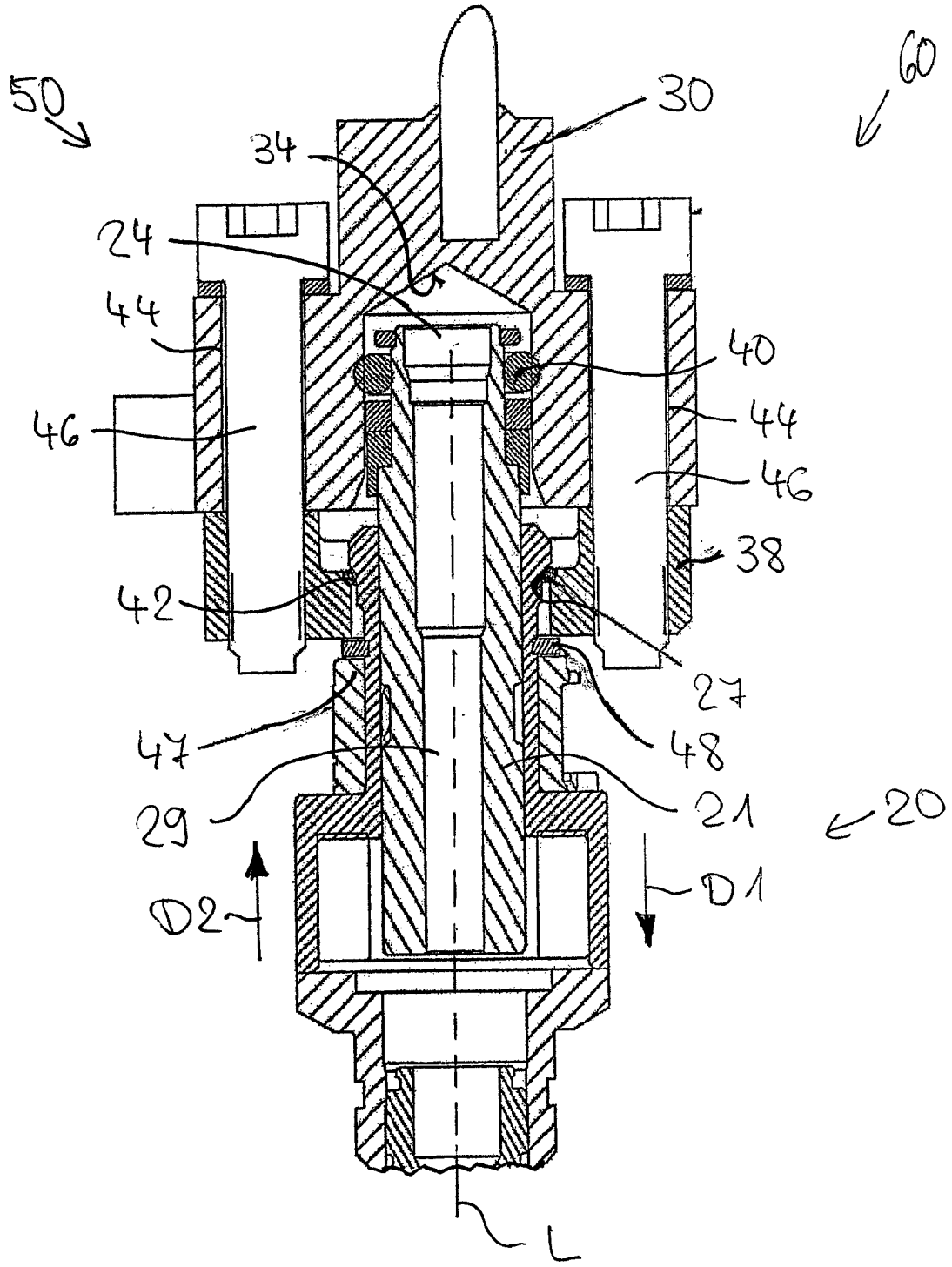

FIGS. 2 and 3 show a fuel injector assembly 60 with the fuel injector 20 and a coupling device 50. The coupling device 50 may be coupled to the fuel rail 18 of the internal combustion engine 22. The coupling device 50 has a fuel injector cup 30 and a plate element 38. The fuel injector cup 30 comprises an inner surface 34 and is hydraulically coupled to the fuel rail 18. The fuel inlet portion 24 of the fuel injector 20 comprises a sealing ring 40. The sealing ring 40 enables an engagement of the fuel injector cup 30 with the fuel inlet portion 24 of the fuel injector 20.

The coupling device 50 has a snap ring 42 which is arranged in the groove 27 of the fuel injector 20. Furthermore, the plate element 38 is in engagement with the snap ring 42. Consequently, the plate element 38 is fixedly coupled to the fuel injector 20. The snap ring 42 enables a positive fitting coupling between the plate element 38 and the fuel injector 20 to prevent a movement of the fuel injector 20 relative to the plate element 38 in a first direction D1.

The fuel injector cup 30 and the plate element 38 comprise through holes 44. The fuel injector cup 30 and the plate element 38 are fixedly coupled with each other by screws 46. Each of the screws 46 is received by one of the through holes 44 of the fuel injector cup 30. Each of the screws 46 is screwed into the plate element 38.

As the plate element 38 is fixedly coupled to the fuel injector 20 by the snap ring 42 and the fuel injector cup 30 is fixedly coupled to the plate element 38 by the screw 46, the fuel injector 20 is retained in the fuel injector cup 30 in direction of the central longitudinal axis L.

The fuel injector 20 has a shoulder 47 which extends in radial direction. A circlip 48 is arranged axially between the shoulder 47 and the plate element 38. By this a movement of the fuel injector 20 relative to the plate element 38 in a second direction D2 can be prevented wherein the second direction D2 is contrary to the first direction D1.

In the following, the assembly and disassembly of the fuel injector 20 with the fuel injector cup 30 is described:

For assembling, the plate element 38 is shifted over the fuel injector 20 and the snap ring 42 is shifted into the groove 27 of the fuel injector 20. Furthermore, the plate element 38 is shifted over the fuel injector 20 until it is in a positive fitting coupling with the fuel injector 20 to prevent a movement of the fuel injector 20 relative to the plate element 38 in the first direction D1 of the central longitudinal axis L.

Furthermore, the fuel inlet portion 24 of the fuel injector 20 is shifted into the fuel injector cup 30 in a way that the fuel injector cup 30 and the plate element 38 are in engagement with each other. Then, the screws 46 are screwed into the plate element 38. Now the inner surface 34 of the fuel injector cup 30 is in sealing engagement with the sealing ring 40. Finally, the circlip 48 is arranged between the plate element 38 and the shoulder 47 and a state as shown in FIGS. 2 and 3 is obtained. By this, a movement of the fuel injector 20 relative to the fuel injector cup 30 in the first direction D1 is prevented. After the assembly process fuel can flow through the fuel injector cup 30 into the fuel inlet portion 24 of the fuel injector 20 without fuel leakage.

To disassemble the fuel injector 20 from the fuel injector cup 30, the circlip 48 is disassembled from the shoulder 47 of the fuel injector body 21. Then the screws 46 are removed and the fuel injector 20 can be shifted away from the fuel injector cup 30 in axial direction and the fuel injector cup 30 and the fuel injector 20 can be separated from each other.

The circlip 48 between the plate element 38 and the shoulder 47 allows an assembly of the fuel injector 20 and the fuel injector cup 30 in a manner that a movement of the fuel injector 20 relative to the fuel injector cup 30 can be prevented in both directions D1, D2 of the central longitudinal axis L. During the mounting of the plate element 38 and the snap ring 42 there is enough space to enable a limited movement of the fuel injector 20 relative to the plate element 38 and the snap ring 42. The circlip 48 may be easily mounted between the plate element 38 and the shoulder 47. During the mounting the circlip 48 does not exert an additional force on the injector 20. As the circlip 48 can be arranged outside the fuel injector cup 30 the circlip 48 can be assembled and disassembled without disassembling the injector 20 from the fuel injector cup 30 and the fuel rail 18.

What is claimed is:

1. A fuel injector assembly with a fuel injector and a coupling device for hydraulically and mechanically coupling the fuel injector to a fuel rail of a combustion engine, the fuel injector having a central longitudinal axis, the coupling device comprising:

a fuel injector cup configured to be hydraulically coupled to the fuel rail and to engage a fuel inlet portion of the fuel injector, a plate element fixedly coupled to the fuel injector cup and comprising a groove, and a snap ring arranged in the groove and configured to fixedly couple the plate element to the fuel injector to retain the fuel injector in the fuel injector cup in direction of the central longitudinal axis and to prevent a movement of the fuel injector relative to the plate element in a first direction of the central longitudinal axis, wherein a circlip is arranged axially between the fuel injector and the plate element to prevent a movement of the fuel injector relative to the plate element in a second direction of the central longitudinal axis opposing the first direction of the central longitudinal axis.

2. The fuel injector assembly of claim 1, wherein the fuel injector comprises a shoulder extending in radial direction and the circlip is arranged axially between the shoulder and the plate element.

3. The fuel injector assembly of claim 2, wherein the plate element and the fuel injector cup are designed and arranged to enable a screw coupling between the plate element and the fuel injector cup.

4. A coupling device for a fuel injector assembly having a fuel injector and a coupling device for hydraulically and mechanically coupling the fuel injector to a fuel rail of a combustion engine, the fuel injector having a central longitudinal axis, the coupling device comprising:

a fuel injector cup configured to be hydraulically coupled to the fuel rail and to engage a fuel inlet portion of the fuel injector, a plate element fixedly coupled to the fuel injector cup and comprising a groove, and a snap ring arranged in the groove and configured to fixedly couple the plate element to the fuel injector to retain the fuel injector in the fuel injector cup in direction of the central longitudinal axis and to prevent a movement of the fuel injector relative to the plate element in a first direction of the central longitudinal axis, wherein a circlip is arranged axially between the fuel injector and the plate element to prevent a movement of the fuel injector relative to the plate element in a second direction of the central longitudinal axis opposing the first direction of the central longitudinal axis.

5. The coupling device of claim 4, wherein the fuel injector comprises a shoulder extending in radial direction and the circlip is arranged axially between the shoulder and the plate element.

6. The coupling device of claim 4, wherein the plate element and the fuel injector cup are designed and arranged to enable a screw coupling between the plate element and the fuel injector cup.

7. A combustion engine comprising:

a fuel injector having a central longitudinal axis, a fuel rail, a coupling device for hydraulically and mechanically coupling the fuel injector to the fuel rail, the coupling device comprising:

a fuel injector cup configured to be hydraulically coupled to the fuel rail and to engage a fuel inlet portion of the fuel injector, a plate element fixedly coupled to the fuel injector cup and comprising a groove, and a snap ring arranged in the groove and configured to fixedly couple the plate element to the fuel injector to retain the fuel injector in the fuel injector cup in direction of the central longitudinal axis and to prevent a movement of the fuel injector relative to the plate element in a first direction of the central longitudinal axis, wherein a circlip is arranged axially between the fuel injector and the plate element to prevent a movement of the fuel injector relative to the plate element in a second direction of the central longitudinal axis opposing the first direction of the central longitudinal axis.

8. The combustion engine of claim 7, wherein the fuel injector comprises a shoulder extending in radial direction and the circlip is arranged axially between the shoulder and the plate element.

9. The combustion engine of claim 7, wherein the plate element and the fuel injector cup are designed and arranged to enable a screw coupling between the plate element and the fuel injector cup.

* * * * *